United States Patent [19]

Wittmann et al.

[11] Patent Number: 4,607,859

[45] Date of Patent: Aug. 26, 1986

[54] SAFETY SKI BINDING

[75] Inventors: Heinz Wittmann, Vienna; Friedrich Leichtfried, Traiskirchen; Emilie Szabo, Schwechat; Tibor Szasz, Vienna, all of Austria

[73] Assignee: TMC Corporation, Baar, Switzerland

[21] Appl. No.: 580,996

[22] Filed: Feb. 16, 1984

[30] Foreign Application Priority Data

Feb. 16, 1983 [AT] Austria ..... 517/83
Nov. 11, 1983 [AT] Austria ..... 3989/83

[51] Int. Cl.[4] ..... A63C 9/08
[52] U.S. Cl. ..... 280/632; 280/634
[58] Field of Search ..... 280/628, 631, 632, 634

[56] References Cited

U.S. PATENT DOCUMENTS 4,475,742 10/1984 Bauer et al. ..... 280/632

FOREIGN PATENT DOCUMENTS 369282 12/1982 Austria .
369661 1/1983 Austria .
072903 3/1983 European Pat. Off. .
2838904 3/1980 Fed. Rep. of Germany .
3405616 8/1984 Fed. Rep. of Germany .
2489159 3/1982 France .
500730 2/1971 Switzerland .

*Primary Examiner*—David M. Mitchell
*Assistant Examiner*—Richard M. Camby
*Attorney, Agent, or Firm*—Flynn, Thiel, Boutell & Tanis

[57] ABSTRACT

The invention relates to a safety ski binding, in particular a heel holder, comprising a sole holder which is pivotal about a transverse axle supported on a bearing block secured to a base plate. The sole holder is under the influence of an opening spring which urges it into its opened position. The sole holder is held in the downhill skiing position by a locking rocker arm pivotally supported on the sole holder. The locking rocker arm has on the one side thereof a locking projection which, in the downhill skiing position, grips under a control-cam member arranged on the bearing block and on the other side thereof a locking notch into which is received a locking member at least in the downhill skiing position urged by at least one spring. The locking member is supported in a spring housing which is swingable on the bearing block and is movable to a limited extent with respect thereto, whereby for the voluntary opening of the sole holder a release lever supported on the sole holder is provided, which carries a bolt which couples the release lever to the spring housing.

17 Claims, 14 Drawing Figures

1

SAFETY SKI BINDING

FIELD OF THE INVENTION

This invention relates to a safety heel ski binding and, more particularly, to a heel binding having structure for making it possible to open the binding by activating the release spring.

CROSS REFERENCE TO RELATED APPLICATION

This application is related to application Ser. No. 580,904 filed concurrently herewith.

BACKGROUND OF THE INVENTION

Such a safety ski binding is known through a product which is available in the marketplace and has proven to be very successful in practice for several years. In this heel holder, the sole holder and the spring housing are pivotally supported on a common axle provided at the rear portion of the bearing block. During a voluntary opening of the sole holder by pulling up on the release lever, the engagement of the locking member is released from the locking notch on the locking rocker arm, which causes same to become disengaged from the bearing-block-fixed control-cam member to enable the sole holder to pivot upwardly practically freely about its pivot axle. Following a voluntary opening of the sole holder, the heel holder, however, is not in a position to steppingly receive a ski shoe therein. To re-insert the ski shoe or to close the sole holder, an additional manipulation is required. For example, first the release lever is closed by applying a force so that the locking member again snaps into the locking notch in the locking rocker arm. Subsequently the sole holder can be closed by pressing down thereon. However, it is also possible to insert the ski shoe into the sole holder, close same and only then press the release lever into its closing position and thus the locking member into the locking notch in the locking rocker arm.

In the safety ski binding which is described in Austrian Pat. No. 369 282 (see in particular FIGS. 9 to 13 thereof), the sole holder is pivotally supported on an axle, which is separate from the pivot axle of the spring housing and is arranged on the upper region of the bearing block. In the downhill skiing position of the safety ski binding, a locking rocker arm is pivotally supported on the sole holder and grips under a locking nose which is constructed on the bearing block. The locking rocker arm is loaded by a spring-loaded locking element supported in the spring housing. The locking rocker arm is almost over its entire area divided into two parts, whereby between the two parts of the locking rocker arm a pawl is stored and is also supported on the axle which is provided for the pivotal support for the locking rocker arm. The pawl carries an operating extension loaded by a weak spring. The lower region of the pawl forms with the locking rocker arm a locking notch for the spring-loaded locking member. For opening the sole holder, the operating shoulder of the pawl is pressed down against the force of the weak spring, so that the locking member is released and the spring housing, supported by a torsion spring, can pivot upwardly. The sole holder can now swing up freely together with the locking rocker arm, the pawl which has been let go in the meantime grips again the locking member, so that the binding is in the position ready to steppingly receive a ski shoe therein. For closing the heel holder, the sole holder is to be swung down against the force of the release spring, and there is no possibility in this heel holder to close the sole holder against a smaller force.

Austrian Pat. No. 369 661 illustrates a similar embodiment, in which the sole holder and the release lever can be pivoted about a common axle supported in the upper region of the bearing block, whereby the spring housing, as was described earlier, can be pivoted about a pivot axle which is provided in the lower and rear portion of the bearing block. The release lever is thereby in this embodiment coupled with the spring housing by means of a bolt, so that the voluntary release occurs by an upward pivoting of the release lever, whereby in this conventional binding type an easy voluntary release can take place by a change of the relative position between the locking member and the locking rocker arm. Since the change of the relative position according to the known solution requires the arrangement of a row of teeth on the locking member, selectively across from which grooves or teeth are provided on the locking rocker arm, the development of this type of connection is relatively complicated and susceptible to breakdown. Furthermore for changing the relative position either the locking rocker arm must be adjustable transversely with respect to the longitudinal axis of the binding or the spring housing must be adjustable in direction of its axis of rotation. Also this design requires an increased construction expense, so that the mentioned disadvantages up to now stood in the way of the practical utilization of this type of binding.

From Swiss Pat. No. 500 730 (FIGS. 1 to 4) a solution is known in which the release spring is arranged in an opening lever which, in the top view, is formed as a U-shaped structural part. Thus, in this case, the opening lever and the spring housing are identical structural parts, which are pivotal about a common transverse axle supported in the bearing block. The locking rocker arm is also supported on the bearing block, so that during a release operation it can carry out only a swinging movement, however, no elevational movement. The sole holder itself is pivotal about a further transverse axle which is also supported in the bearing block.

From this design results the operating mode that the release spring during a voluntary release operation must be compressed to the same degree as in an automatic release operation. Thus, the locking rocker arm remains constantly under the action of the release spring, so that the sole holder during the entire removal of the shoe heel is spring-loaded. Thus, in this conventional solution no easy stepping-out can occur.

The known solution discloses in the form of a tension spring the use of a return spring, which after letting go of the release lever brings it again into engagement with the locking rocker arm. The release lever also defines a spring housing. This return is possible in the known construction due to the circumstance that the release spring is not relaxed in any position of the release lever or of the spring housing; rather for construction reasons it is constantly more initially tensioned during a voluntary release. Also a re-entry of the ski shoe into the binding requires overcoming the release spring which is now received in the initially tensioned position in the locking notch in the locking rocker arm.

Therefore, the purpose of the invention is to provide a safety ski binding of the above-mentioned type such that it is in the position ready to steppingly receive a ski shoe therein after a voluntary opening, whereby also the possibility exists of again closing the sole holder against a relative small force.

The set purpose is inventively attained by providing a stop on a stationary part of the heel holder, against which stop, viewed in the phase of the voluntary release in which the locking member is disengaged from the locking notch in the locking rocker arm and the sole holder is in a position between its closed and opened position, the spring housing abuts against a support portion thereof, so that in the following phase of the voluntary opening, a relative pivoting movement occurs between the sole holder and the spring housing.

Through the inventive measures the heel holder automatically attains its position ready to steppingly receive a ski shoe therein during a voluntary opening of the sole holder by operation of the release lever. Since the pivotal movement of the spring housing is limited by the stop with respect to the sole holder, it is assured that the locking rocker arm will swing away from the locking member to a degree which permits a re-entry of the locking member into the locking notch in the locking rocker arm without operating the release spring, namely practically without force. The heel holder can be closed by a mere swinging down of the sole holder. However, a manual closing with substantially less force is also possible. To accomplish this, the locking member is again removed from the locking notch through an upward pivoting of the release lever, through a downward pivoting of the sole holder and a subsequent pressing down on the release lever in order for the heel holder to reach its closed position. Therefore, the heel holder has all the advantages of the known and successful binding, whereby, however, in addition the operating comfort is substantially improved.

A particularly advantageous and simple embodiment of the invention consists in the stop being formed by the pivot axle of the sole holder, which pivot axle is supported in the bearing block. Through this it is not necessary to use a separate structural part as a stop and to secure same on a stationary area of the heel holder, for example on the bearing block.

A further characteristic of the invention consists in the support region on the spring housing being provided on its cover and in the region being designed preferably resiliently. In this manner the spring housing can be designed for the counterstop without substantial changes on the heel holder. Furthermore the possibility for storing and arranging an additional spring which favors the return of the spring housing is created.

A preferred embodiment of the invention consists in the support portion of the spring housing being constructed as a resilient tongue, for example as a leaf spring, which extends into the interior of the binding. In this embodiment, the storing and arranging of the support portion, which is designed as a spring on the spring housing, is particularly simple. Furthermore, this spring is initially tensioned only after the swinging movement of the spring housing, when it then rests on the stop. Thus, the spring is relaxed in the skiing position during an automatic release and also in the first phase of a voluntary release, so that its force must not be overcome.

The subject matter of the invention is also a further simplification of the above-described solutions. In particular the designer has a greater selection with respect to the development in the inner portion of the heel holder and greater tolerances with respect to the development and arrangement between the stop and the support portion on the cover.

The so-set purpose is inventively attained by the stop being formed either by the rear free end portion of the base plate or the holding plate of the bearing block or on one of these plates, and by the support portion of the spring housing being formed by a forwardly projecting extension of the rear end portion of the cover, which end portion also covers the spring housing which is coupled to the release lever.

These measures simplify the construction from which also result technological advantages in the manufacture. Furthermore, a simpler dimensioning of these portions is possible. Also, slightly greater tolerances are permissible without negatively affecting the operating mode or performance. The heel holder can, for the development of the stop, be rebuilt without significant changes and particularly simply. Furthermore, the possibility is created for storing and arranging an additional spring which assists the return of the spring housing, and the spring can, if desired, be easily exchanged. Through this, if needed, the spring characteristic can be changed or a possibly broken spring can be easily replaced.

A preferred embodiment of this further development consists in the stop being supported at the end portion of the base plate or the bearing block springy, for example by the interpositioning of a spring and being guided preferably with slip motion on the end portion. In this embodiment the storing and arranging of the resilient stop or its spring is particularly simple. Furthermore, this spring is initially tensioned only after the swinging movement of the spring housing when it rests on the stop. Thus, the spring is relaxed in the skiing position, during an automatic release and also in the third phase of a voluntary release, so that its force must not be overcome.

According to a different characteristic of the invention the stop can be constructed in one piece with the base plate or with the holding plate of the bearing block. This measure is favorable for manufacturing reasons. However, it will be used in particular when according to a further characteristic of the invention the extension of the cover is supported resiliently on the stop, for example by means of a rubber or plastic spring.

The tongue or the resilient support of the extension provided on the cover can now inventively be manufactured in one piece with the cover. These measures bring about additional technically preferable manufacturing advantages.

A further development of the invention consists in the axle which supports the locking rocker arm being supported in two arcuate slotted holes which extend on the side walls of the release lever and extend on a radius to the pivot axle for the sole holder, by the release lever being supported from above on the pivot axle for the sole holder, and by the sole holder having for the bolt secured on the release lever an enlarged opening in each side wall thereof. From these inventive measures result the possibility of voluntarily opening the heel holder both by a pressing down onto the release lever and also by a pulling up on the release lever. During an opening by pulling up on the release lever, the axle which supports the locking rocker arm functions as a pivot axle for the release lever. During an opening caused by pressing down on the release lever, the pivot axle for the sole holder acts simultaneously as a pivot axle for the release lever, whereby the relative movement between the axle which supports the locking rocker arm and the release lever is made possible by the two slotted holes in the release lever. In both cases the heel holder, following a voluntary opening, is in the position ready to steppingly receive a ski shoe therein.

In this embodiment of the invention, it is preferable for the support portion of the release lever to be rounded corresponding with the radius of the pivot axle for the sole holder. From this results a favorable force distribution during an opening caused by pressing down on the release lever.

In order to now be able to accomplish in this embodiment a closing of the sole holder from its open position with a small force, and according to a further characteristic of the invention, it is provided that the pivotal range of the release lever is determined by the two slotted holes in the release lever being rendered inactive by means of a voluntarily operable block. This permits a closing of the heel holder with a small force to be accomplished during an active block, as was already mentioned.

This block can now be inventively formed by a spring-loaded slide member supported on the release lever for movement in the longitudinal direction of the release lever, which slide member has at one end an operating shoulder which can be gripped manually and at the other end has at least one hook-shaped gripping element, which by operating the slide member grips around the axle for the locking rocker arm.

A further block which can be stored easily can be formed by a spring-loaded slide member which is supported on the release lever for movement in the longitudinal direction of the release lever, which slide member has at one end an operating shoulder which can be gripped manually and at the other end is divided or fork-shaped and has two support elements thereat which straddle the locking rocker arm and by operating the slide member can be moved under the axle of the locking rocker arm and support same from below.

It is furthermore inventively important that the force of the resilient stop, for example its spring, or of the spring which is provided on the sole holder and which loads the locking rocker arm, for example the torsion spring, or the force of the resilient support portion of the spring housing, as for example the resilient tongue, the leaf spring, the resilient extension of the cover or the spring is less, preferably substantially less, than the force of the opening spring which loads the sole holder. This enables the desired return of the spring housing to be assured without influencing the upward pivoting of the sole holder and thus the release of the ski shoe.

BRIEF DESCRIPTION OF THE DRAWINGS

Further characteristics, advantages and details of the invention will now be described in greater detail with reference to the drawings, which illustrate several exemplary embodiments of an inventive safety ski binding.

In the drawings:

FIG. 1O*a* shows an enlarged cross-sectional view of a modified slide member.

FIG. 1O*b* is a top plan view of the modified slide member of FIG. 1O*a*.

DETAILED DESCRIPTION

Figure 1:
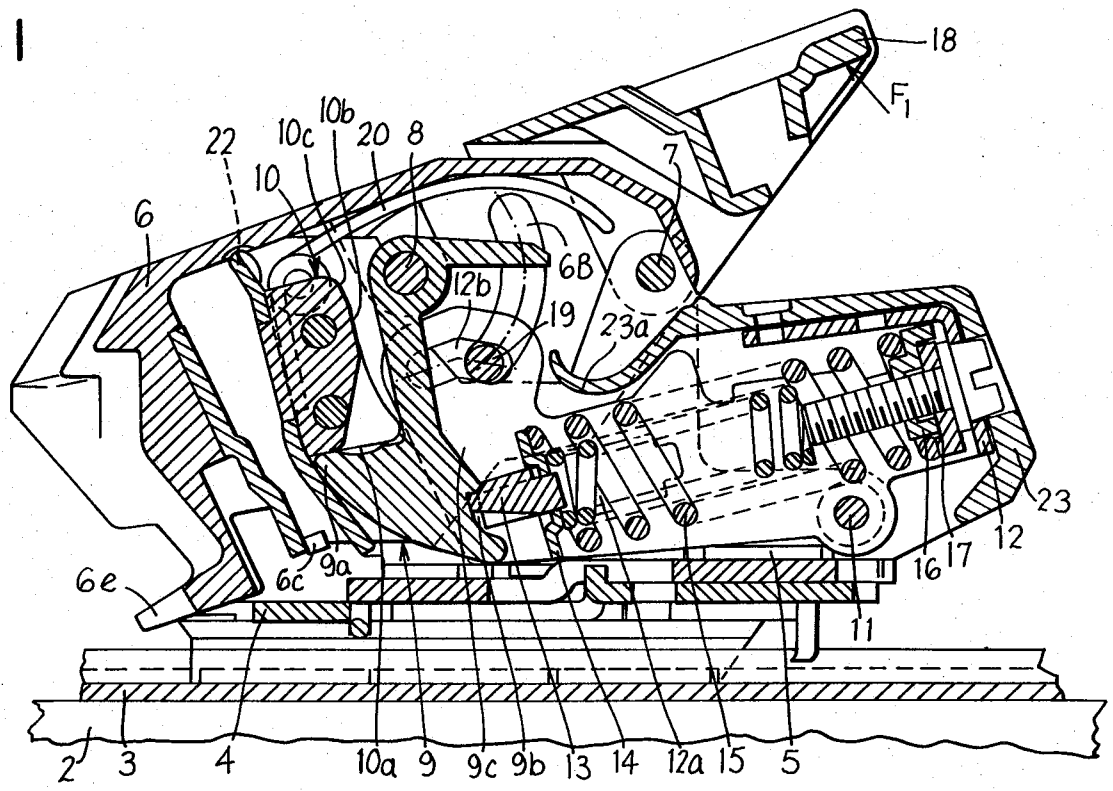
FIG. 1 is a longitudinal cross-sectional view of a first exemplary embodiment of the safety ski binding in the skiing position.
Figure 2:
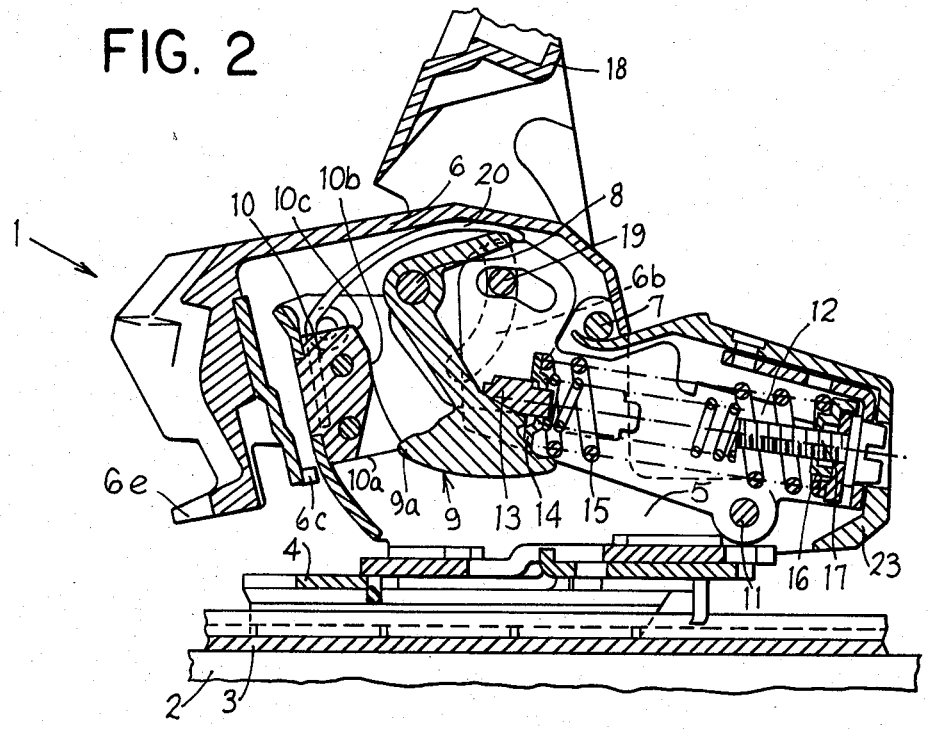
FIG. 2 is a longitudinal cross-sectional view of the binding during a voluntary opening procedure.

The safety ski binding according to FIGS. 1 to 4 is constructed as a heel holder which is identified in its entirety by the reference numeral 1. The heel holder 1 has a guide rail 3 which is secured to the upper side of the ski 2 by means of screws (not illustrated). Base plate 4 of the heel holder is movably guided in the longitudinal direction of the ski 2 on the guide rail 3 and facilitates in a conventional manner an adjustment of the binding to different length ski shoes and can be locked in any respective desired position. The heel holder 1 is movably guided on the guide rail 3 against the force of at least one thrust spring (not illustrated), the thrust spring being supported in a conventional manner at one end on a ski-fixed member and at the other end on the base plate 4 of the heel holder 1. A housinglike bearing block 5 is secured to the base plate 4 and has a pivot axle 7 located on an upper portion thereof, which pivot axle extends transversely with respect to the longitudinal axis of the ski and which is formed from a pin or bolt. A sole holder 6 is pivotally supported on the pivot axle 7. The sole holder 6 has at its upper region, forwardly of the axle 7, a further axle 8 which extends parallel with respect to the first-mentioned axle 7 and is also formed from a pin or bolt. A locking rocker arm 9 is pivotally supported on the axle 8 and extends substantially downwardly therefrom and has at its lower end region a forwardly extending locking projection 9*a* which, in the downhill skiing position of the heel holder according to FIG. 1, grips under a control-cam member 10 which is provided on the front wall of the housinglike bearing block 5.

A further axle 11 which also extends transversely with respect to the longitudinal axis of the ski is arranged at the rear end region of the bearing block 5, which axle pivotally supports a spring housing 12 which is provided within or between the lateral side walls of the bearing block 5. The spring housing 12, which in the top view is approximately U-shaped, has on its two side walls longitudinally extending slots or guideways 12*a* which movably guide a locking member 13. The locking member 13, which extends substantially transversely with respect to the longitudinal axis of the ski between the side walls of the spring housing 12, is constructed wedge-shaped at one end and has a flange-like extension on the end thereof remote from the wedge-shaped region. A spring washer 14 is supported on the extension and supports one end of at least one release spring 15. The other end of the release spring 15 is supported on an adjustable spring abutment 16, which can be adjusted in a conventional manner in the axial direction of the release spring by means of a screw 17 which is rotatably supported in the spring housing 12.

The locking rocker arm 9 has a locking notch **9*b* formed therein and is adapted to receive the locking member 13 therein under the urging of the release spring 15. A recess 9*c* is also provided in the locking rocker arm immediately above the locking notch 9*b*. The forward end of the slots 12*a* will limit the forward movement of the locking member 13 so that the wedge-shaped end will not engage the rear side of the rocker arm or will not engage it with effective spring force from the release spring 15** during a voluntary opening of the sole holder through operation of a release lever in a manner which will yet be described.

The release lever 18 laterally grips over or straddles the sole holder 6 and is hingedly supported on the axle 8 arranged on the sole holder 6. The locking rocker arm 9 is also pivotally supported on the axle 8. A bolt or pin 19 is secured on the release lever 18 and extends parallel with respect to the axle 8 and extends through slots in the side walls of the sole holder 6 and also through slots in the side walls of the spring housing 12. That is, the bolt or pin 19 extends through arcuate slotted holes **6*b* extending on a radius of the axle 8 provided on the sole holder 6. An approximately arc-shaped connecting guide 12*b* is provided on a plate-like shoulder of the spring housing 12**.

The control-cam member 10 which operatively cooperates with the locking rocker arm 9 forms, viewed from the upper side of the ski, first a control surface **10*a* under which grips the locking projection 9*a* of the locking rocker arm 9 in the downhill skiing position of the heel holder 1. The control surface 10*a* of the control-cam member 10 determines the elasticity range of the heel holder 1 and transfers through a corner section, defining the release point, into a section 10*b* which extends upwardly away from the corner and the upper side of the ski, which section 10*b* in its upper end region has a locking section 10*c* which is inclined in a forward direction toward the sole holder 6**.

The sole holder 6 is under the action of an opening spring 20, which is constructed as a torsion spring and urges the sole holder in the opening direction. The opening spring 20 is provided in an upper end region of the control-cam member 10 in a recess therein. One leg of the torsion spring engages the sole holder 6 on an inside upper surface and the other leg engages the bearing block 5 on a rearwardly facing wall thereof. A stop for the upward pivoting movement of the sole holder 6 is formed by at least one forwardly extending bent section or tab 22 on the bearing block 5, against which a shoulder **6*c* on the sole holder 6 will engage during an upward pivotal movement of the sole holder 6**.

A housinglike cover 23, which is preferably made of plastic, covers the rearward end portion of the spring housing 12 and is fixedly connected to the spring housing 12, for example is riveted thereto. The cover 23 thus pivots together with the spring housing 12. The cover 23 is equipped with a window having a scale adjacent thereto with appropriate indicia for indicating the initial adjusted spring tension. Since this construction is known by itself, the window is not illustrated separately in the drawings.

The front part of the cover 23 is provided with an extension which extends over the spring housing 12. This extension is formed by a slightly curved, some millimeters wide, resilient tongue **23*a*. The resilient tongue 23*a* is, in the downhill skiing position of the heel holder according to FIG. 1, spaced from and below the pivot axle 7 of the sole holder 6 and in the region below said pivot axle 7**.

The heel holder 1 of FIGS. 1 to 4 operates as follows:

If a force from a ski shoe (not illustrated) inserted into the binding acts in a vertical direction onto the sole holder 6, then the sole holder 6 pivots upwardly about its pivot axle 7. During this pivotal movement, the locking projection **9*a* of the locking rocker arm 9 slides rearwardly along the control surface 10*a* of the bearing-block-fixed control-cam member 10 and urges the locking member 13 back against the force of the release spring 15 in the longitudinal guideways 12*a* of the spring housing 12. The spring housing 12 will also pivot therewith about its axle 11 through the action of the locking rocker arm 9 which is under the influence of the release spring 15. The locking rocker arm 9 moves upwardly together with the sole holder 6. As soon as the locking projection 9*a* of the locking rocker arm 9 has exceeded the release point of the control-cam member 10, which is an equivalent to an exceeding of the elasticity range for the binding, the sole holder 6 pivots, urged by the opening spring 20, into its open position whereat the locking projection 9*a* of the locking rocker arm 9 engages the locking section 10*c* of the control-cam member 10. The release spring 15 can, at this location, relax until the locking member 13 engages the forward ends of the longitudinal guideways 12*a* of the spring housing 12 adjacent the locking rocker arm 9. The binding is now in the ready-for-stepping-in position illustrated in FIG. 3. A closing of the binding from this position can be accomplished by inserting a ski shoe and by simply pushing down on the sole holder 6 into the position illustrated in FIG. 1. The heel of the ski shoe obviously operatively engages the spur 6*e*** to effect the aforesaid action.

If now the heel holder 1 is to be manually opened, the release lever 18 is then pivoted upwardly in direction of the arrow $F_1$, shown in FIG. 1, for example manually. The spring housing 12 is also pivoted upwardly about the axle 11 by action of the pin or bolt 19 which is thereby forced upwardly in the slotted holes **6*b* of the sole holder 6, which slotted holes extend on a radius to the axle 8 so that the locking member 13 becomes disengaged from the locking notch 9*b* of the locking rocker arm 9 against the force of the release spring 15. This freeing is assured by the wedge surface of the locking member 13 sliding along the upper boundary of the locking notch. After the locking member leaves the locking notch 9*b* under action of the release lever 18, the locking member 13 is urged forwardly under the action of the release spring 15 in the longitudinal guideways 12*a* of the spring housing 12 until it strikes the forward ends of the two longitudinal guideways 12*a*. This particular movement is made possible by a corresponding dimensional relation of the recess 9*c* on the locking rocker arm 9 located immediately above the locking notch 9*b*. The locking rocker arm 9 can now, according to FIG. 3, freely pivot away from the control-cam member 10 and permit a subsequent upward movement of the sole holder 6 under the action of the opening spring 20 according to FIG. 3 and a movement of the locking projection 9***a* upwardly past the control-cam member 10.

The operation of the release lever 18 and the subsequent, automatic upward pivoting of the sole holder 6 does now permit a recognition of the following phases of the voluntary release.

In the first phase, there occurs a pulling up of the release lever 18 and the opening on the binding. The locking member 13 becomes free from engagement with the locking rocker arm, so that also the sole holder will lift off slightly from its closed position and adopt the position illustrated in FIG. 2. As can furthermore be seen from FIG. 2, the pivot axle 7 of the sole holder 6 stands in the path of upward movement of the resilient tongue 23*a*. The tongue 23*a* is thereby slightly tensioned, as is illustrated through a comparison of the resilient tongue 23*a* in the position according to FIGS. 1 and 2.

In the next-following phase of the voluntary opening, which has not been illustrated separately, the pin or bolt 19 extends into the two slotted holes 6*b* of the sole holder 6 and, when it is in its highest position, the resilient tongue 23*a* is completely tensioned, the sole holder 6 is swung higher and the locking rocker arm 9 with its locking projection 9*a* thereon has assumed, relative to the control-cam member 10, also a higher position, however, not yet the highest position.

Figure 3:
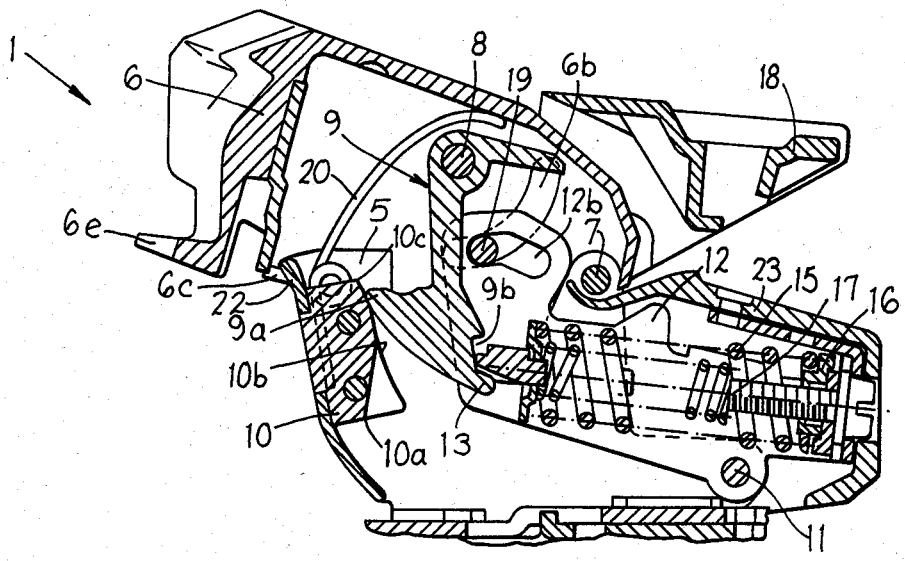
FIG. 3 is a longitudinal cross-sectional view of the binding in the open position following the voluntary opening or following a safety release.

In the fourth phase of the voluntary opening, the sole holder 6 under the action of the opening spring 20 is in its completely open position, as is illustrated in FIG. 3. During the upward pivoting of the sole holder 6 in this position, the locking rocker arm 9 is in the highest position and the spring housing 12 is urged downwardly under the force of the now relaxing resilient tongue 23*a* on the cover 23, so that the locking member 13 is again received in the locking notch 9*b* of the locking rocker arm 9. This return swinging of the spring housing 12 can, of course, only occur when the release lever 18 has been released by the skier and swings back around the bolt 19 into its closed position, as this is illustrated in FIG. 3. The heel holder is now ready for a ski shoe to step therein.

The dimensioning of the cooperating structural parts, as in particular the shape of the section 10*b* of the control-cam member 10, permits the just-described sequences of movement to occur. In the open position of the heel holder 1 according to FIG. 3, the locking projection 9*a* of the locking rocker arm 9 rests on the locking section 10*c* of the bearing-block-fixed control-cam member 10. The so-created free space or recess 9*c* is inventively important, because the locking member 13 can only, through this free space, move again without resistance thereto, namely without operation of the release spring 15, into the locking notch 9*b* of the locking rocker arm 9.

Figure 4:
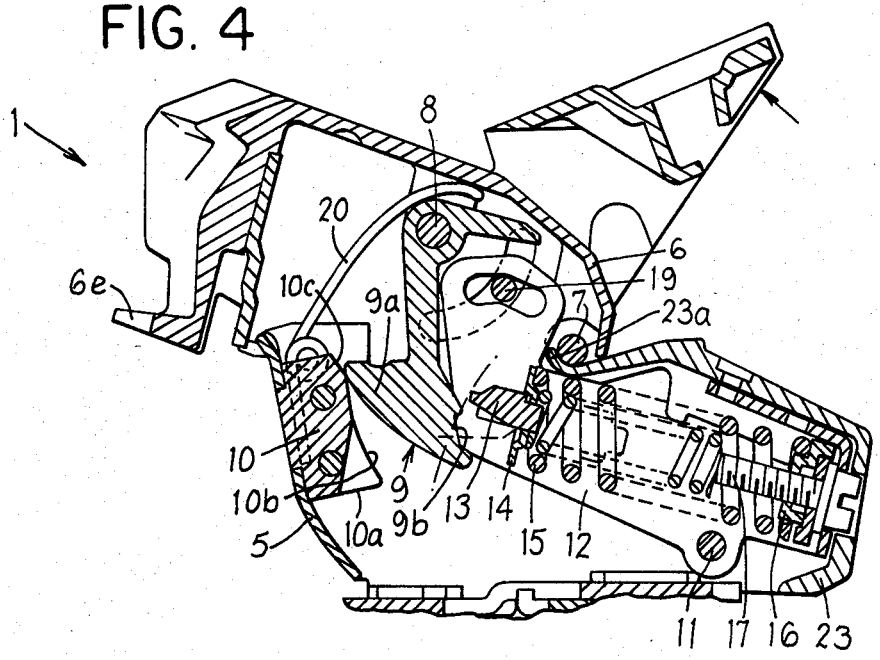
FIG. 4 is a longitudinal cross-sectional view of the binding in a position facilitating voluntary closing with little use of force.

Following a voluntary opening of the heel holder, it is ready for a ski shoe to step therein and be closed by a mere inserting of the ski shoe into the sole holder 6 and stepping down with the heel on the spur 6*e* as above described. Also a manual closing of the sole holder 6 is possible by pressing down thereon. However, it will be necessary to overcome a relatively large force. It is possible, however, to move the heel holder with a substantially smaller force into its closed position. For this purpose, and starting out from the position illustrated in FIG. 4, the release lever 18 is swung up sufficiently far until the locking member 13 again becomes disengaged from the locking notch 9*b* of the locking rocker arm 9. This operation occurs, as is illustrated in FIG. 4, only against the small force of the resilient tongue 23*a*. The sole holder 6 is subsequently moved manually into its closing position, and only the force of the opening spring 20, which force is small compared with the force of the release spring 15, need be overcome. The locking member 13 again is received in the locking notch 9*b* of the locking rocker arm 9 through the action of the release lever 18, which now for example is manually swung again into the closing direction so that during this operation the release spring 15 will become slightly compressed. In this manner the heel holder can be moved manually with little force into its closing position. This mode of operation is chosen primarily when the heel holder is to be closed during transport of the skis. It is also preferable to make this feature available to the binding installer so that an adjustment of the binding to the ski shoe length can be made with ease.

Figure 5:
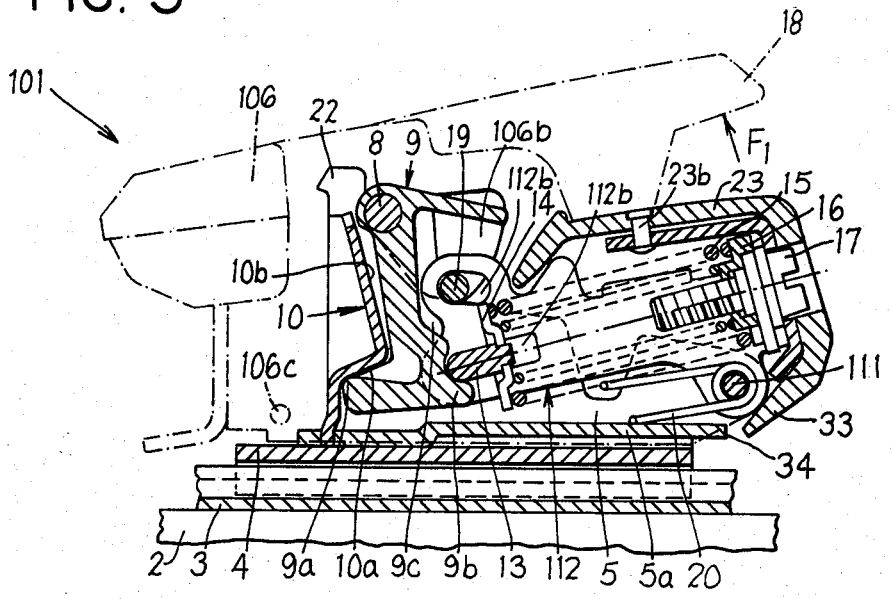
FIG. 5 is a longitudinal cross-sectional view of a second exemplary embodiment of the safety ski binding in the skiing position.
Figure 6:
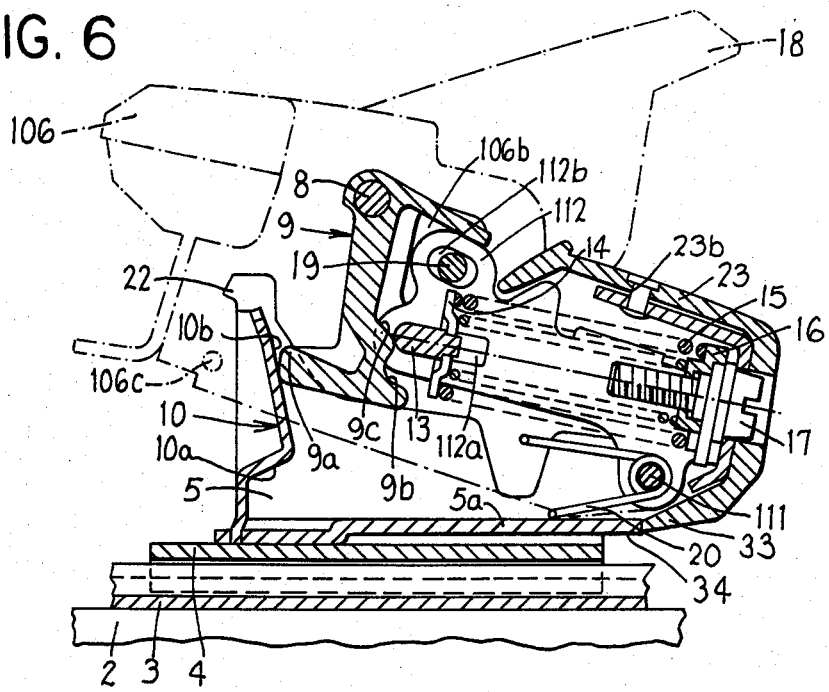
FIG. 6 is a longitudinal cross-sectional view of the binding during a voluntary opening procedure.
Figure 7:
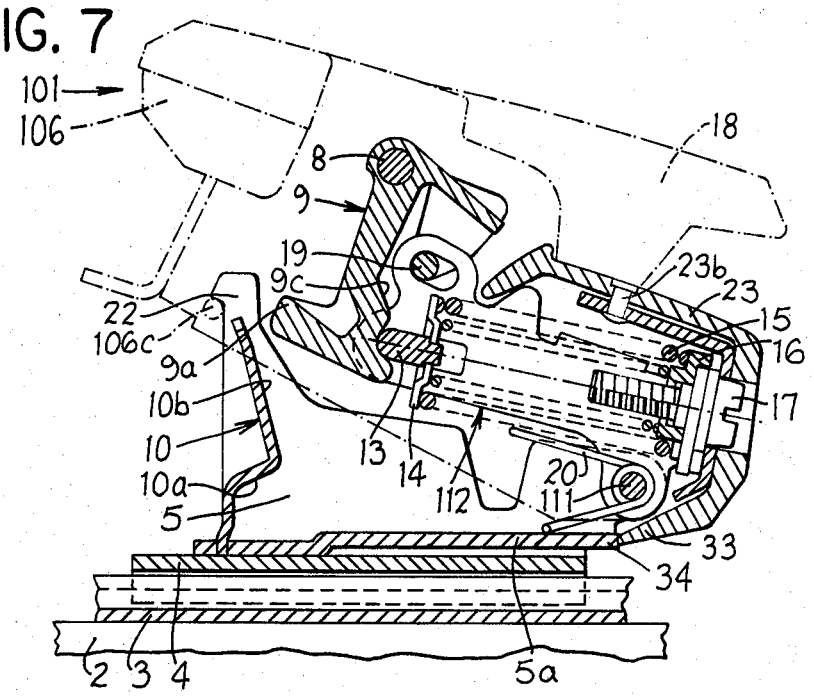
FIG. 7 is a longitudinal cross-sectional view of the binding in the open position following the voluntary opening or following a safety release.

The embodiment according to FIGS. 5 to 7 differs from the one according to FIGS. 1–4 primarily by the sole holder 106 being supported on a transverse axle 111 provided on the rear portion of the bearing block 5. The transverse axle 111 also pivotally supports the spring housing 112. Due to this arrangement, however, the pin or bolt 19 extends, on the one hand, through enlarged openings 106*b* in the side walls of the sole holder 106 and, on the other hand, through a slotted hole 112*b* provided in each one platelike shoulder on the spring housing 112. The openings 106*b* are located adjacent the release lever 18 and each has a rear edge that extends concentrically with respect to the axle 8. Furthermore, the use of a locking section 10*c* on the control-cam member 10, as was described above, is not needed in this embodiment.

The part of the plastic cover 23 that covers the spring housing 12 at the rear end thereon is provided at its rear end with an extension 33 that extends downwardly and forwardly toward base plate 4 and the holding plate 5*a* of the bearing block 5. The holding plate 5*a* of the bearing block 5 has at its rearwardly extended end portion a stop surface 34. As shown in FIG. 6, the end surface 34 of the holding plate 5*a* itself can be constructed or can be active as a stop. The end surface on the extension 33 of the cover 23 lies in the skiing position of the heel holder 101 at an initial spacing from the stop surface 34 of the holding plate 5*a* as shown in FIG. 5.

The operation of the heel holder 101 of FIGS. 5 to 7 corresponds, during an automatic opening, to the previously described embodiment.

If now the heel holder is to be opened manually, the release lever 18 is then again pivoted upwardly, for example manually, in direction of the arrow $F_1$ which is illustrated in FIG. 5, to effect the release of the locking rocker arm 9 and the locking member 13 in the same manner as described above. The operation of the release lever 18 and the subsequent, automatic swinging up of the sole holder 6 facilitates a recognition in this embodiment of the following phases of the voluntary release, of which two are illustrated in FIGS. 6 and 7.

In the first phase, there occurs the opening and the pulling up of the release lever 18, so that the locking member 13 becomes disengaged from the locking notch 9*b* of the locking rocker arm 9 to thereby enable the locking projection 9*a* to move without any resistance away from the control surface 10*a* of the control-cam member 10. After the user has finished this manipulation, he releases the release lever 18 so that same will swing back about the axle defined by the bolt 19 into its closed position. This position of the release lever 18 is illustrated in FIG. 7 and it must be remarked that this figure illustrates a position of the entire heel holder 1 which will be discussed below.

FIG. 6 illustrates the position of the voluntary opening, in which the release lever 18 is still being held in a raised position by the user, however, the locking rocker arm 9 has released the sole holder 106 so that same, under the action of the opening spring 20, can swing up from its closed position. An upward pivotal movement of the sole holder 106 takes upwardly along therewith the locking rocker arm 9 by means of the axle 8. The locking rocker arm 9 will, in turn, also effect an upward swinging of the spring housing 112 due to the locking member 13 being engaged therewith. FIG. 6 illustrates an intermediate position, that is one where the sole holder 106 is not yet at its highest position. The extension 33 of the cover 23, however, is engaged with the stop surface 34 of the holding plate 5*a*, so that the spring housing 112 is blocked from a further pivotal movement. Only the sole holder 106 can swing further upwardly under the action of the opening spring 20 and can take further therewith the locking rocker arm 9.

In the next-following third phase of the opening, which has not been separately illustrated, it will be recalled that the pin or bolt 19 is received in the two slotted holes 112*b* of the spring housing 112 and attains its uppermost position when both the sole holder 106 has assumed its highest position and the locking rocker arm 9 has also assumed its highest position. The distance (space) which has been created or which exists between the locking member 13 and the section 10*b* of the control-cam member 10 assures an easy, unhindered sliding movement of the locking rocker arm 9 therebetween.

In the fourth phase of the voluntary opening, as illustrated in FIG. 7, the locking rocker arm 9 attains through its own weight a position in which the locking member 13 is again received in the locking notch 9*b* of the locking rocker arm 9, namely the locking rocker arm 9 is swung back and, supported on the locking member 13, held in a position which is suited for a ski shoe to step into the binding. By pressing down with the heel of the ski shoe on the spur 106*e* on the sole holder 106, the heel holder 101 can, as has already been described in connection with an automatic release, close and can be moved into the position illustrated in FIG. 5.

To be complete, it must be stated that as soon as the user lets go of the release lever 18, it will swing back automatically into its closed position by the opening sole holder 106. This automatic swinging back of the release lever 18 occurs through the forced control between the two enlarged slots 106*b* in the sole holder 106 and the pin or bolt 19 on the release lever 18.

The dimensioning of the cooperating structural parts, as in particular the shape of the section 10*b* of the control-cam member 10, causes the just-described sequences of movement. In the open position of the heel holder 101, in which the sole holder 106 is completely swung up, the locking projection 9*a* on the locking rocker arm 9 can yield forwardly in direction of the upper free end of the section 10*b* of the bearing-block-fixed control-cam member 10 in order to permit the locking member 13 to again be received in the locking notch 9*b* in the locking rocker arm 9, whereby the upper boundary of said locking notch 9*b* must again be overcome. The so-created free positioning capability for the locking member 13 is inventively important, because the locking member 13 can only reach this condition due to the free space between the section 10*b* and the locking lever arm so that again the locking member 13 is effortlessly received in the locking notch 9*b* of the locking rocker arm 9.

Figure 8:
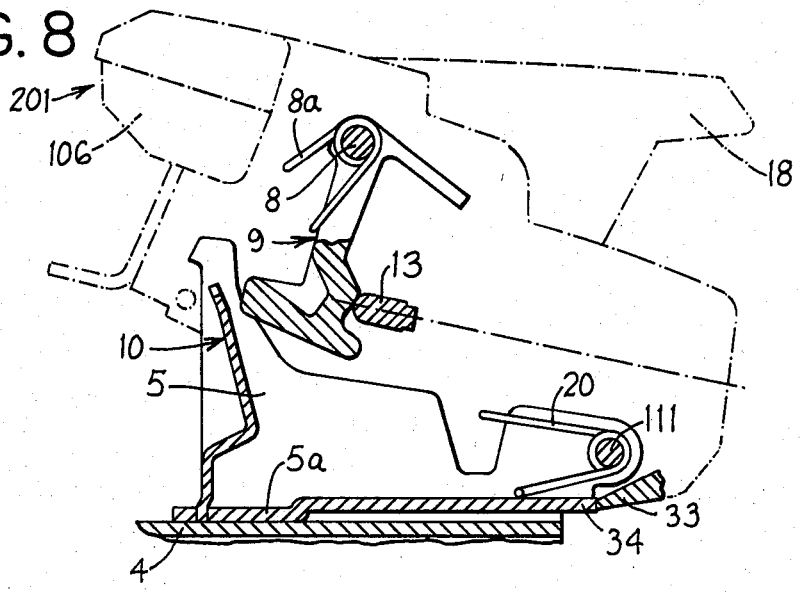
FIG. 8 is a partially sectioned schematic illustration of a third exemplary embodiment in a position which corresponds approximately with FIG. 2.

FIG. 8 illustrates a modification of the embodiment of a heel holder 201 according to FIGS. 5 to 7 in that a further light or relatively weak torsion spring 8*a* is provided on the axle 8, which spring loads with one leg the locking rocker arm 9 in direction of the spring housing 112 and loads with the other leg the sole holder 106. It is important that the spring be advantageously and inventively arranged such that it receives its initial tension by swinging the locking rocker arm 9 during an upward swinging movement of the sole holder 106 and after urging the locking member 13 of the spring housing 112 forwardly. This causes the spring 8*a* to urge the locking rocker arm 9 in a direction toward the locking member 13 as the sole holder 106 is swung further upwardly to cause a forced overcoming of the boundary surface of the locking notch 9*b* on the locking rocker arm 9. Thus, a catching or snagging of the locking rocker arm 9 on the control-cam member 10 due to ice formation thereon is avoided. Otherwise, the engagement between the locking member 13 and the locking notch 9*b* on the locking rocker arm 9, which engagement is needed to facilitate a stepping entry of a ski shoe into the binding, would not take place.

Figure 9:
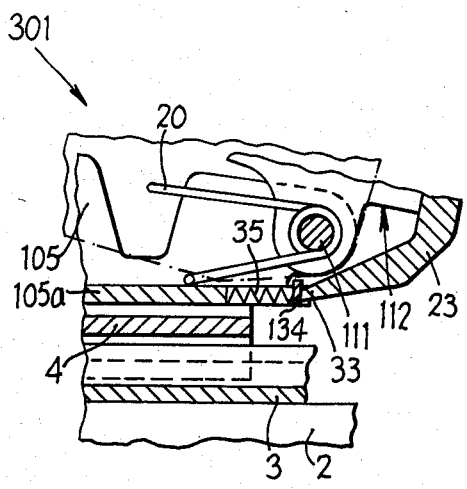
FIGS. 9 and 10 illustrate a fourth exemplary embodiment similar to FIGS. 6 and 7, however, only with respect to the details which have been changed.
Figure 10:
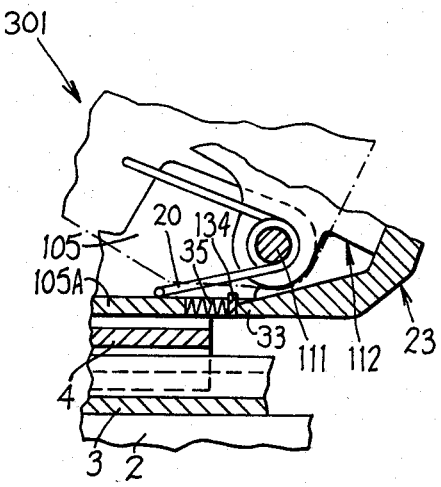
Figure 10A:
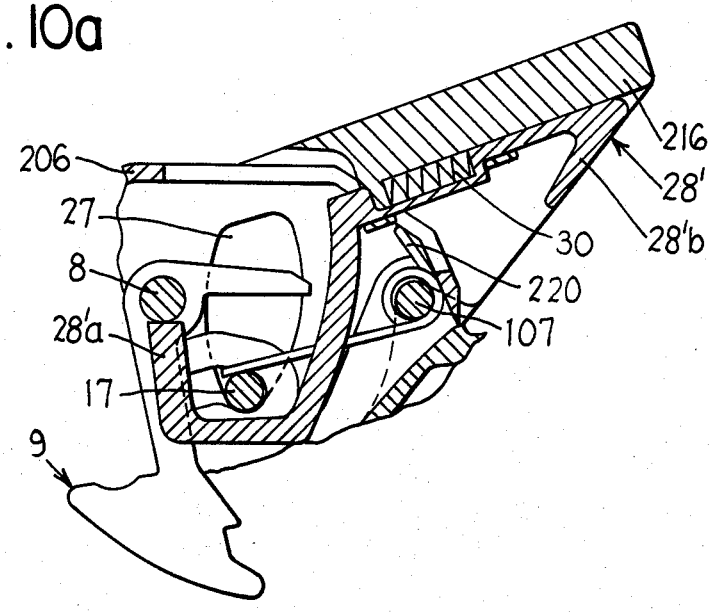
Figure 10B:
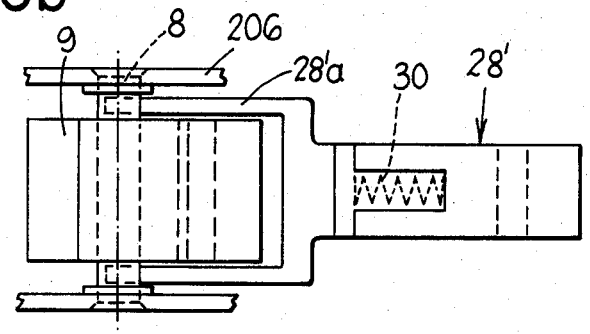

FIGS. 9 and 10 illustrate a third embodiment of a heel holder 301, however, only a rear portion thereof. As will be recognized from FIGS. 9 and 10, the stop surface 134 at the rear end of the holding plate 105*a* on the bearing block 105 supports one end of a spring 35. The end region of the holding plate 105*a* is thereby constructed as a type of a sliding guide for the stop surface 134. The extension 33 of the cover 23, as illustrated in FIG. 9, engages the resiliently supported stop surface 134 and has urged same already slightly forwardly against the force of the spring 35, so that this position of the partially illustrated heel holder 301 corresponds approximately to FIG. 6 of the preceding exemplary embodiment with the difference being that the spring housing 112 has not yet attained its highest pivoted position. According to FIG. 10, the spring housing 112 has already attained its highest pivoted position. This position corresponds approximately to the position illustrated in FIG. 7. The further design and the operation of the heel holder 301 correspond substantially to the first exemplary embodiment with the difference being that the support for and swinging movement of the extension 33 of the cover 23 occurs against the force of the spring 35, so that this causes the re-entry of the locking member 13 of the spring housing 112 into the locking notch 9*b* on the locking rocker arm 9 by the action of the spring 35. A dimensioning of the components can, in this region of the binding, be carried out with slightly greater freedom than in the embodiment having a fixed stop surface. Thus, the action of the spring 35 corresponds generally with the action of the spring 8*a* according to FIG. 8.

To be complete, it must also be remarked that the force of the spring 35 is less, preferably substantially less, than the force of the opening spring 20 in the sole holder 106, so that no disadvantageous actions can be created or are to be feared during a voluntary or automatic opening of the heel holder 301.

Following a voluntary opening, the heel holder 101, 201, 301, as described above, is therefore also ready for a ski shoe to step therein and can be closed by a mere insertion of the ski shoe into the sole holder 106. Also a manual closing of the sole holder 106 is possible in all cases by pressing down on the sole holder, however, overcoming a relatively large spring force. However, it is also possible to move the heel holder 101, 201, 301 like the heel holder 1 according to the first exemplary embodiment into its closed position and against a substantially smaller spring force. The operation corresponds to an operational sequence already described.

Figure 11:
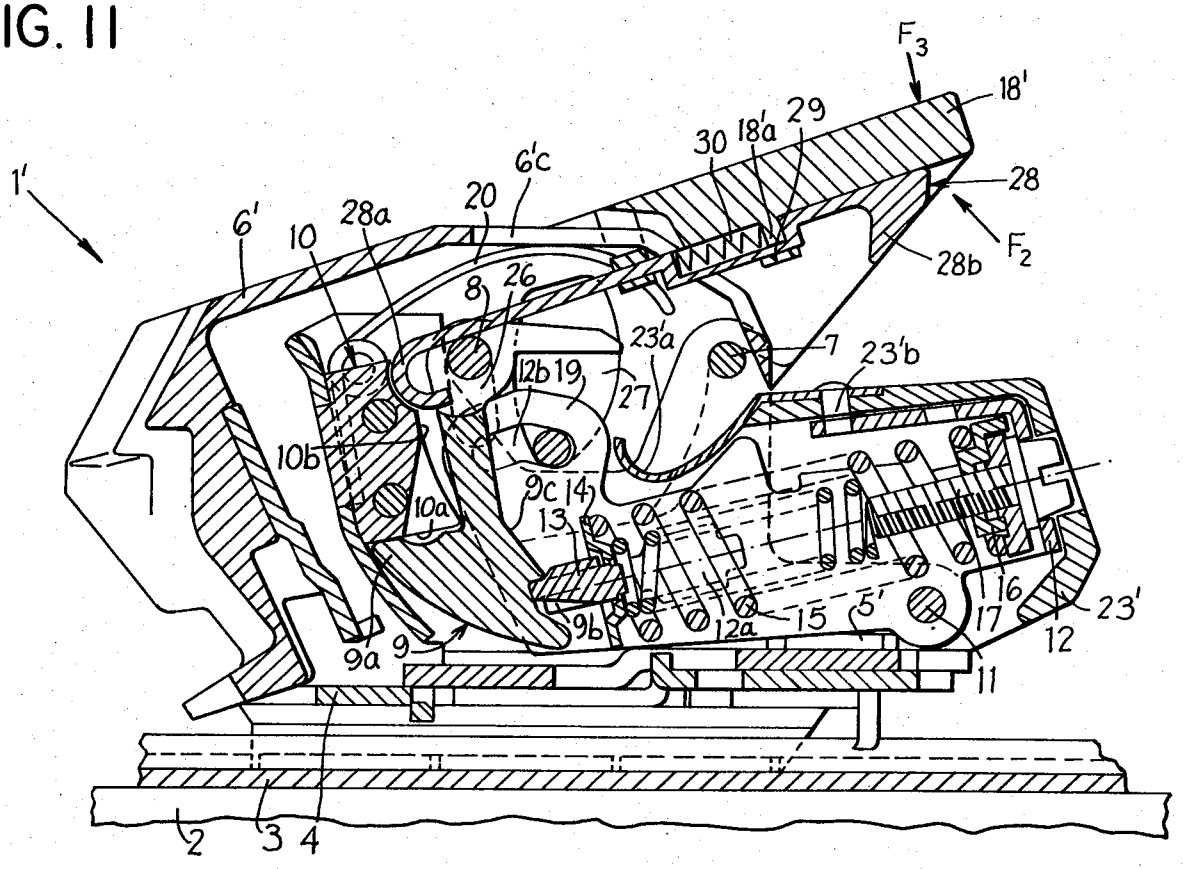
FIG. 11 illustrates a fifth exemplary embodiment in a position corresponding to the position illustrated in FIG. 1.

The heel holder 1', which is illustrated in FIG. 11, corresponds substantially to the heel holder 1 illustrated in FIGS. 1 to 4. The following description discusses only those details constructed differently compared to the first exemplary embodiment. Thus, the sole holder 6' is oriented higher off the upper surface of the ski than in the first exemplary embodiment, so that in the region between the locking rocker arm 9 and the upper cover of the sole holder 6', an unhindered pivotal movement of a slide member 28 secured to the release lever 18' can occur, which pivotal movement will yet be described in greater detail. A slotted hole 26 is provided in each of the side walls of the release lever 18', through which slotted holes 26 extends the axle 8 secured to and movable with the sole holder 6' and which also supports the locking rocker arm 9. Each slotted hole extends on a radius to the pivot axle 7. In the downhill skiing position of the heel holder according to FIG. 11, the axle 8 is oriented at the upper end portion of the slotted holes 26. The release lever 18' is supported from above through its two straddling side walls on the pivot axle 7 for the sole holder 6'. For this purpose, the respective support region for the release lever 18', as is illustrated in FIG. 11, can be curved corresponding to the radius of the pivot axle 7. The bolt or pin 19 which is secured to the release lever 18' extends through the enlarged opening 27 in each side wall of the sole holder 6'. The opening 27 replaces the slotted holes **6*b* of the first exemplary embodiment. The edge boundary of the recess 27 adjacent the axle 8, is rounded on a radius to the pivot axle 7 and the edge boundary of the recess 27 adjacent the pivot axle 7 is rounded on a radius to the axle 8. Furthermore a leaf spring 23'*a* is secured to the cover 23' of the spring housing 12, for example by means of rivets 23*b*, and replaces the resilient tongue 23*a*** illustrated in the first exemplary embodiment.

The slide member 28 is movably supported in the longitudinal direction of the release lever 18' on the underside of the release lever 18'. To support the slide member 28 on the release lever 18', it is possible to provide, for example and as it is illustrated in FIG. 11, one or more guide plates 29 which hold the slide member 28 to the underside of the release lever 18'. The slide member 28 itself extends approximately over the entire length of the release lever 18' and therebeyond in a direction toward the sole holder 6' and terminating above the locking rocker arm 9. The slide member 28 extends through an opening **6'*c* in the upper cover of the sole holder 6', which opening extends in the longitudinal direction of the ski. The slide member 28 has a hook-shaped gripping element 28*a* thereon for gripping around the axle 8 supported on the sole holder 6' in a manner which will yet be described. The locking rocker arm 9 and the control-cam member 10 are for this purpose provided centrally with corresponding recesses which are not identified in detail. The slide member 28 is held in the position illustrated in FIG. 11 by a spring 30 and in which position the gripping element 28*a* is spaced away from the axle 8. The spring 30 is designed as a compression spring and is arranged in a recess in the slide member 28 with one end thereof engaging the slide member 28 and the other end thereof engaging a support shoulder 18'*a* on the release lever 18', which support shoulder projects into the aforesaid recess on the slide member 28. Furthermore, the slide member is provided with an operating shoulder or handle 28*b*** to facilitate manual gripping by the hand.

In a further embodiment according to FIGS. **1O*a* and 1O*b*, the slide member 28' has at one end an operating shoulder 28'*b* which can be gripped manually. The other end portion 28'*a* of the slide member 28' is divided forkshaped and surrounding the bolt 17 so that the slide member 28' can be operated by push or pull against the force of the spring 30. Therefore the spring 30 is always loaded in an appropriate manner (against push or aginst pull). FIG. 1O*a* shows an embodiment in which the slide member 28' can be operated by pull, i.e. in the left direction in the drawing. Doing so the spring 30 will be compressed and the ends of the end portions 28'*a* of the slide member 28' give the axle 8 freedom so that it can move into the slotted holes as it is written above in connection with FIG. 10. Since in the meantime the bolt 17 comes to its upper position, there is enough space for the divided forkshaped end portion 28'*a* to move to the left. If the slide member 28' should be operated by pusing thereon, the ends of the end portions 28'*a*** move right away to the right in the drawing.

The heel holder of FIG. 11 can be opened voluntarily both by pulling up on or by pressing down on the release lever 18'. During an opening by a pulling up on the release lever 18' in the direction of the arrow $F_2$ in FIG. 11, the release lever 18' is supported on the axle 8 which acts as a pivot axle therefor. An unhindered pivoting movement of the release lever 18' with the slide member 28 being carried along therewith is made possible by the recess **6'*c* in the sole holder 6', so that an opening of the sole holder 6' can take place in the manner which has been described above with reference to the first exemplary embodiment of FIGS. 1 to 4**.

If the heel holder is to be opened through application of a downward pressure onto the release lever 18', for example by means of the ski, a ski shoe or a ski pole, the release lever 18' is swung downwardly in direction of the arrow $F_3$ in FIG. 11. The release lever 18' is thereby supported on the bearing-block-fixed axle 7, which now functions as the pivot axle for the sole holder 6' and also as the pivot axle for the release lever 18'. The relative movement which now takes place between the release lever 18' and the axle 8 supported on the sole holder 6', is made possible by the two slotted holes 26 in the release lever 18'. During a pivoting of the release lever 18', the bolt or pin 19 secured to the release lever 18' is moved upwardly, this movement being made possible by the two enlarged openings 27 in the sole holder 6'. The spring housing 12 is also pivoted upwardly about the axle 11 through the action of the bolt 19, so that the locking member 13 becomes disengaged, against the force of the release spring 15, from the locking notch **9*b* of the locking rocker arm 9 and subsequently, as has already been described with reference to the first exemplary embodiment, moves into the region of the recess 9*c* in the locking rocker arm 9. Following a release of the release lever 18', the sole holder 6'** (either through a lifting of the ski shoe which is inserted into the sole holder 6′ or through an opening effected by the opening spring 20) starts to pivot upwardly about the pivot axle 7, the locking rocker arm 9 simultaneously swings slightly downwardly and the axle 8 which supports the locking rocker arm 9 slides slightly upwardly in the slotted holes 26. After a certain angle of traverse of the sole holder 6, the locking rocker arm 9, which slides rearwardly along the control-cam member 10, engages the locking member 13 which is now pivoted up about the axle 11 together with the spring housing 12 and slides along the length of the locking rocker arm 9. The pin or bolt 19 pivots together with the pivoting spring housing 12 to simultaneously cause the release lever 18′, which is now pivotal about the new pivot axle to swing up in the direction of the arrow $F_2$ in FIG. 11 (thus, in an opposite direction to the direction of applied pressure). During a continued pivoting movement of the release lever 18′, it moves away from the pivot axle 7. The locking rocker arm 9 can now pivot upwardly with the sole holder 6′ past the control-cam member 10. In the last phase of the upward pivoting of the sole holder 6′, the leaf spring 23′*a* secured to the cover 23′ of the spring housing 12 and which during the just-described sequences of movement was initially tensioned, becomes active and urges the pin or bolt 19 and thus the spring housing 12 downwardly to cause the locking member 13 to again slide into the locking notch 9*b* in the locking rocker arm 9. This causes the release lever 18′ which supports the bolt 19 to be moved into its closed position, so that now the heel holder 1′ is in its position ready to steppingly receive a ski shoe therein.

The heel holder which is now ready for a ski shoe to step therein can again be closed by pressing down on the sole holder 6′. However, in order to be able to effect a manual closing of the sole holder 6′ with a smaller force, the slide member 28 is provided. The slide member 28 is gripped manually as at 28*b* and is pulled against the force of the weak spring 30 in a direction away from the sole holder 6′. The hooklike gripping element 28*a* eventually grips the axle 8, so that now the two slotted holes 26 are rendered ineffective. In this position of the slide member 28, the release lever 18′ is now swung upwardly sufficiently far until the locking member 13 again becomes free of the locking notch 9*b* in the locking rocker arm 9. This operation occurs only against the small force of the leaf spring 23′*a*. The sole holder 6′ is subsequently moved manually into its closing position, and only the force of the opening spring 20 need be overcome. The release lever 18′ is now manually pivoted into the closing direction with the still operated slide member 28, and the locking member 13 again is received in the locking notch 9*b* in the locking rocker arm 9. Even though this re-entry occurs against the force of the release spring 15, a substantially lesser amount of force is needed than through a direct closing of the sole holder 6′.

In order to make it unnecessary to hold the slide member 28 at all times during the just-described sequence of movement, a resilient detent for the slide member 28 can be provided on the release lever 18′, which detent during the operation of the slide member 28 is received in a corresponding locking recess. An automatic engaging of the slide member 28 is for example possible by making the operating region of the slide member 28 a separate structural part and constructed as a two-arm lever hingedly connected to the slide member 28. One of the lever arms has the operating shoulder 28*b* thereon and a further spring loads the operating shoulder in a direction generally toward the underside of the release lever 18′ and the other lever arm extends away from the underside of the release lever 18′. This second lever arm can now, during a pressing down on the release lever 18′ for example, strike the pivot axle 7, which causes the lever to be pivoted and the locking to be automatically released.

Furthermore it is possible to form the block for the axle 8 from two hooklike gripping elements on the slide member 28, which each can grip around the axle 8 laterally of, that is straddle, the locking rocker arm 9. With this, the provision of a recess in the locking rocker arm 9 is not needed.

To block the axle 8 to facilitate an easier closing of the sole holder 6′, it is possible to provide a slide member with two lateral support plates which can be moved by an operating of the slide member laterally of the locking rocker arm under the axle 8 to support the axle from below. For reasons of space, it would be preferable in this case if the support plates which are provided at the end region of the slide member, viewed in the downhill skiing position of the heel holder according to FIG. 11, would be provided laterally of the locking rocker arm 9 in the region behind the axle 8. Therefore, the slide member is to be moved in a direction toward the sole holder. In place of the support plates, it is also possible to provide gripping elements, which in the nonoperated position of the slide member are in the region behind the axle 8 of the locking rocker arm 9 and are movable laterally of the locking rocker arm 9 on the axle 8 of the same.

Figure 12:
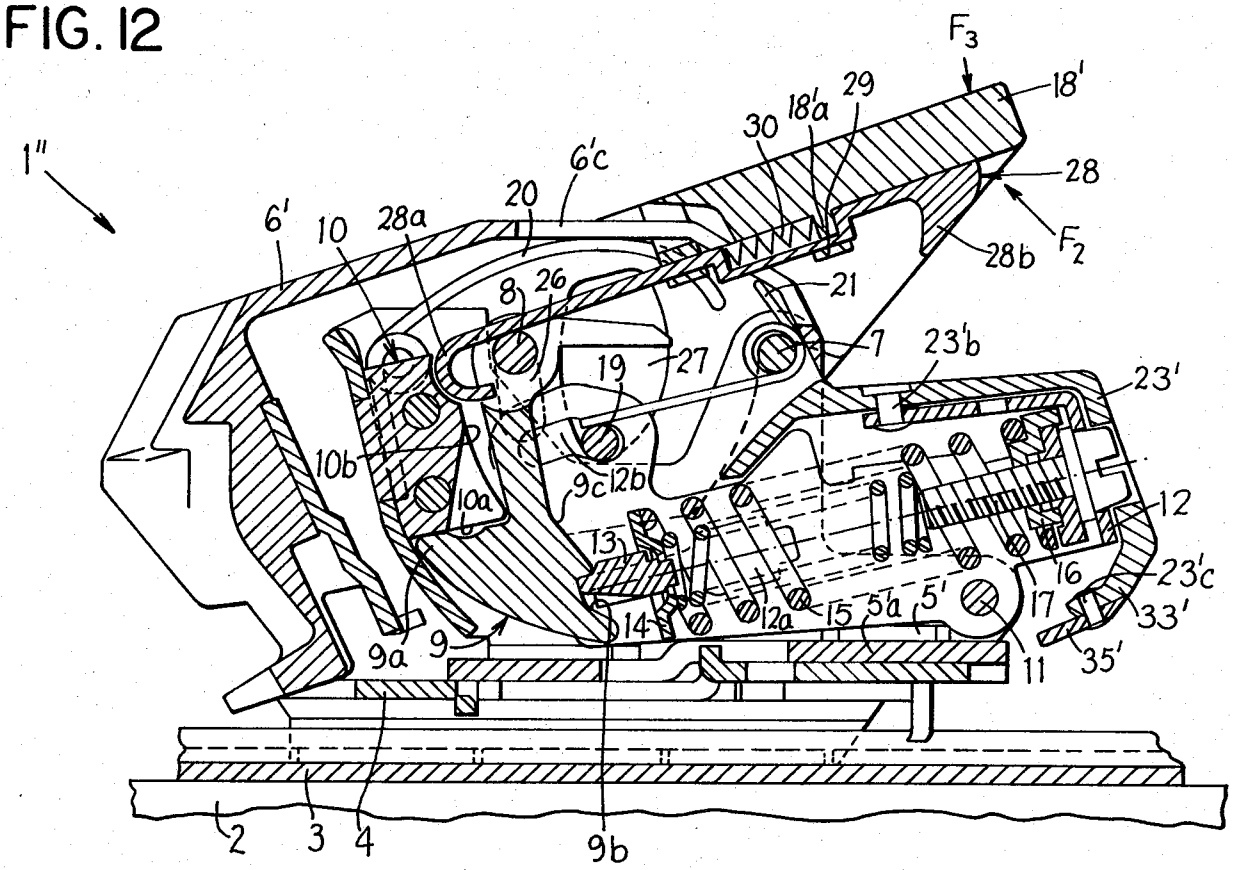
FIG. 12 illustrates a sixth exemplary embodiment in a position corresponding to the position illustrated in FIG. 1.

The heel holder 1″ which is illustrated in FIG. 12 corresponds substantially with the embodiment of FIG. 11. In the now-following description, only those details will be discussed which are constructed differently compared with the exemplary embodiment of FIG. 11. The differences relate primarily to the design of the cover 23″, which does not have a stop surface in its inner end area, however, has an extension 33′ at its rear, forwardly bent end section, similar to FIGS. 5–10.

However, contrary to the exemplary embodiment according to FIGS. 9 and 10, in which the elastic support of the cover 23 on the stop surface 134 is formed by the spring 35, a rubber spring 35′ is provided in the exemplary embodiment of FIG. 12, which rubber spring 35′ is secured, for example by means of rivets 23″*c*, to the extension 33′ of the cover 23″ of the spring housing 12. Due to this change, during a voluntary release operation, the rubber spring 35′ is initially tensioned and effects also, similar as in the exemplary embodiment according to FIG. 11 using the leaf spring 23′*a* for pressing down of the bolt 19, the guiding back of the locking member 13 into the locking notch 9*b* in the locking rocker arm 9. The further modes of operation correspond substantially with the modes which have already been described.

Furthermore, it is possible in both described embodiments of FIGS. 11 and 12 to support the bearing block on a vertical axle secured to the base plate, pivotal out in the horizontal plane and to simultaneously provide a control cam at the front end region of the base plate, which control cam cooperates with a counterstop arranged on the sole holder, so that a so-called diagonal release exists. Since the measures which are needed for this are known by themselves, further discussion of this construction is believed unnecessary.

The invention is not limited to the illustrated exemplary embodiments. Further modifications are conceivable without departing from the scope of the invention. Thus, it is possible to use the leaf spring according to FIG. 11, which leaf spring is used in place of the extension on the cover constructed as a resilient tongue in the embodiment according to FIGS. 1 to 4 or in the embodiment according to FIG. 5 a spring which is designed as an extension of the cover.

It is furthermore conceivable to replace the mechanical spring 35 which is provided in the holding plate 105*a* of the bearing block 105 with another elastic element, for example a rubber spring. However, it is also possible to design, in place of the rubber spring which is provided on the extension of the cover, the extension or at least its end region itself resiliently flexible, for example by designing this end region with means of cross-grooves for carrying out a slight deformation, however, without causing a permanent change in the plastic material of the cover, such as tears or breaks. Furthermore, it is conceivable in the exemplary embodiments according to FIGS. 11 and 12 to form the block for the axle of the locking rocker arm through a rocking lever.

The embodiments of the invention in which an exclusive property or privilege is claimed are defined as follows:

1. In a heel holder of a safety ski binding having a sole holder and first support means pivotally supporting said sole holder for movement between opened and closed positions and about a transverse axle supported on a bearing block secured to a base plate, an opening spring for continually urging said sole holder into said opened position, a locking rocker arm pivotally supported on said sole holder for holding said sole holder in said closed position, said locking rocker arm having on one side thereof a locking projection which, in said closed position, grips under a control-cam member arranged on said bearing block and having, on the other side thereof, a locking notch into which is received a locking member, at least one spring for continually urging said locking element toward said locking rocker arm, said one spring being supported in a spring housing, a second support means pivotally supporting said spring housing on said bearing block for limited movement with respect to said bearing block, a release lever for facilitating a voluntary movement of said sole holder between said closed and opened positions, said release lever being movably supported on said sole holder and having a bolt which couples said release lever to said spring housing, the improvement comprising wherein a stop means is provided on at least one of said base plate and said bearing block of said heel holder, said stop means abutting against a support region on said spring housing only during a voluntary release whereat said locking member is disengaged from said locking notch on said locking rocker arm and said sole holder is in a position between said closed and opened positions thereof, wherein coupling means are provided for relatively movably coupling said spring housing and said sole holder, said support region defining a fulcrum for urging said spring housing toward said closed position thereof in response to a continuing urging of said sole holder to said openend position by said opening spring so that the following phase of said voluntary release will cause a relative movement between said sole holder and said spring housing and a return of said locking element into said locking notch.

2. The binding according to claim 1, wherein said stop means is formed by said first support means for said sole holder, said first support means being on said bearing block.

3. The binding according to claim 1, wherein said support region is provided on a cover surface of said spring housing, and wherein said support region is resiliently yieldable.

4. The binding according to claim 3, wherein said support region on said spring housing is constructed as a resilient tongue extending internally of said binding.

5. The binding according to claim 1, wherein said stop means is defined by a part on at least one of a rearwardly facing end region of said base plate and a holding plate portion of said bearing block, and wherein said support region on said spring housing is defined by a forwardly projecting extension of a rear end region of a cover which covers at least a portion of said spring housing.

6. The binding according to claim 5, wherein said part of said stop means is a spring, said spring being yieldable in a direction parallel to a longitudinal axis of a ski.

7. The binding according to claim 5, wherein said part of said stop means is constructed in one piece with said at least one of said base plate and said holding plate portion of said bearing block.

8. The binding according to claim 7, wherein said extension of said cover is resiliently yieldable.

9. The binding according to claim 4, wherein said resilient tongue is manufactured in one piece with said cover.

10. The binding according to claim 1, wherein said coupling means includes an axle defining the pivotal support for said locking rocker arm, said axle being received in two laterally spaced arcuately slotted holes in side walls on said release lever, said slotted holes extending on a radius of said first support means for said sole holder, wherein said release lever is pivotally supported on said axle for said sole holder, and wherein said sole holder has an enlarged opening into which is received said bolt on said release lever.

11. The binding according to claim 10, wherein one edge of said enlarged opening receiving said bolt therein is rounded on a radius of said first support means for said sole holder.

12. The binding according to claim 10, wherein the pivotal range of said release lever is determined by the length of said two slotted holes in said release lever, and wherein blocking means are provided for holding said axle for said locking rocker arm in a fixed position relative to said release lever.

13. The binding according to claim 12, wherein said blocking means is defined by a spring-loaded slide member and third support means for movably supporting said slide member in the longitudinal direction of said release lever on said release lever, said slide member having at one end an operating shoulder which can be gripped manually and at the other end at least one hook-shaped gripping element adapted to grip around said axle of said locking rocker arm.

14. The binding according to claim 12, wherein said blocking means is defined by a spring-loaded slide member and third support means for movably supporting said slide member in the longitudinal direction of said release lever on said release lever, said slide member having at one end an operating shoulder which can be gripped manually and is divided fork-shaped at the other end and carries two laterally spaced support elements which extend laterally of said locking rocker arm, an operation of said slide member effecting a movement under said axle of said locking rocker arm.

15. The binding according to claim 6, wherein a return force of said yieldable resilient stop means is substantially less than the force of said one spring which loads said sole holder.

16. The binding according to claim 8, wherein said extension is made of an elastic rubber or plastic.

17. The binding according to claim 5, wherein said part of said stop means is a spring, and wherein a further spring is provided for urging said locking lever toward said locking member, said further spring being a torsion spring mounted on said first support means for said sole holder.

* * * * *